US009518434B1

(12) United States Patent
Champness et al.

(10) Patent No.: US 9,518,434 B1
(45) Date of Patent: Dec. 13, 2016

(54) SYSTEM FOR ASCERTAINING AND MANAGING PROPERTIES OF A CIRCULATING WELLBORE FLUID AND METHOD OF USING THE SAME

(71) Applicant: Drill Cool Systems, Inc, Bakersfield, CA (US)

(72) Inventors: Al T Champness, Bakersfield, CA (US); Anthony Worthen, Houston, TX (US)

(73) Assignee: Drill Cool Systems, Inc., Bakersfield, CA (US)

( * ) Notice: Subject to any disclaimer, the term of this patent is extended or adjusted under 35 U.S.C. 154(b) by 541 days.

(21) Appl. No.: 14/061,481

(22) Filed: Oct. 23, 2013

(51) Int. Cl.
*E21B 21/06* (2006.01)
*E21B 21/01* (2006.01)
*E21B 21/08* (2006.01)

(52) U.S. Cl.
CPC ..... *E21B 21/06* (2013.01); *E21B 21/01* (2013.01); *E21B 21/08* (2013.01)

(58) Field of Classification Search
CPC ..... E21B 21/01; E21B 21/06; E21B 21/08
See application file for complete search history.

(56) References Cited

U.S. PATENT DOCUMENTS 4,215,753 A 8/1980 Champness
5,715,895 A 2/1998 Champness et al.
6,176,323 B1 1/2001 Weirich et al.
2007/0045265 A1* 3/2007 McKinzie, II ..... C07C 4/02 219/207
2009/0236144 A1 9/2009 Todd et al.
2011/0028357 A1* 2/2011 Abad ..... C09K 8/03 507/219
2011/0284209 A1 11/2011 Carpenter et al.
2013/0146357 A1 6/2013 Lovorn
2013/0192834 A1 8/2013 Schneider

OTHER PUBLICATIONS

Drilling Engineering Association Article submitted Apr. 14, 1999, entitled "DI-84-Intellidril-Diagnostics-While-Drilling".
Sandia National Laboratories Report SAND2009-0248, entitled "Development of a High-Temperature-Diagnostics-While-Drilling Tool" printed Jan. 2009, Albuquerque, NM.

* cited by examiner

*Primary Examiner* — William P Neuder
(74) *Attorney, Agent, or Firm* — James M. Duncan, Esq.; Klein DeNatale Goldner

(57) ABSTRACT

A system and a method of ascertaining and managing the properties of a circulating wellbore fluid is utilized, among other things, to achieve greater well control, reduce drilling and work-over expense, prevent reservoir damage and prevent personnel injuries which may result from extremely hot wellbore fluids. The system utilizes a network of sensors which detect fluid properties at various locations in the system, inputs the detected properties into a digital processor, and utilizes the processor to generate solutions for adjusting system components to realize a desired temperature and pressure profile for the fluid system.

23 Claims, 2 Drawing Sheets

FIGURE 2
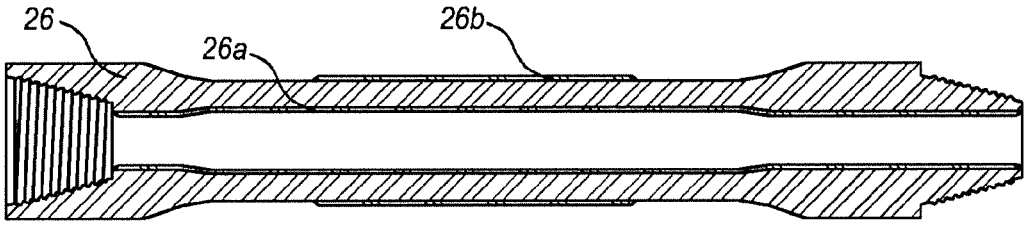
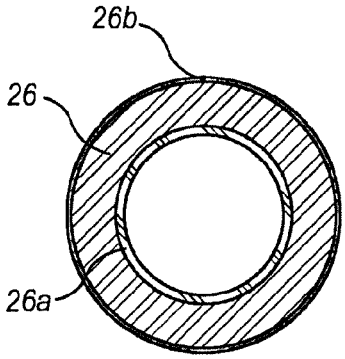
FIGURE 3

SYSTEM FOR ASCERTAINING AND MANAGING PROPERTIES OF A CIRCULATING WELLBORE FLUID AND METHOD OF USING THE SAME

BACKGROUND OF THE INVENTION

Embodiments of the present invention relate to the management of wellbore fluids utilizing in drilling and workover operations for wells constructed for recovery of natural resources, which may include wells for producing oil, gas, geothermal resources, water, and other minerals. The typical application for this invention will be in wells in which high temperatures and/or pressures are encountered in the drilling or workover operation. However, embodiments of the present invention may also be utilized in applications where the properties of the circulating fluid are impacted by lower temperatures and/or pressures, or scenarios in which both extremely cool and hot temperatures are encountered. For example, a hydrocarbon well which is drilled from an offshore drilling vessel in very deep water may encounter very cool temperatures in the marine riser, but may encounter extremely hot temperatures as the well penetrates deep strata. Likewise, wells drilled in Artic locations may have extremely cold temperatures in strata near the surface, but may encounter very hot temperatures in deeper strata as the drilling operation proceeds.

Different types of fluids circulated are circulated in wellbores for a variety of purposes. Among other purposes, fluids are circulated to: (1) maintain a pressure balance with formation pressures which may be encountered in the wellbore; (2) cool a drilling assembly; (3) remove drill cuttings and other materials from the wellbore; (4) transmit hydraulic energy to the bit and drilling assembly; (5) suspend cuttings when drilling operations are paused; (6) seal permeable formations to prevent damage to producing reservoirs; (7) limit corrosion in downhole tubulars; and (8) facilitate cementing and completion operations. The fluids circulated in the wellbore include drilling muds of all kinds, completion fluids (such as packer fluids, perforating fluids, and corrosion inhibitors), stimulation fluids (such as acid, solvents, and frac fluids), foaming agents, and other known fluids circulated within wellbores in the petroleum and natural resources industries. Embodiments of the present invention may be used with these fluids, or combinations thereof. The term "circulating wellbore fluid" as used in this disclosure and within the following claims shall be understood to be referring to these and other known fluids which are circulated within a wellbore.

Many of the fluids utilized for circulation in the wellbore are non-Newtonian fluids, where the fluid viscosity is dependent on pressure, temperature, and the velocity at which the fluid flows through the hydraulic system. The hydraulic system for these applications, and used for embodiments of the present invention, is formed by the wellbore (which may have a cased hole portion and an open-hole portion, and, in offshore operations, a marine riser extending through the body of water), a drill string or working string inside the wellbore (which may be formed by drill pipe or tubing and may include a bottom hole assembly comprising a bit, drill collars, stabilizers, logging tools, mud motors, directional drilling components, and other components), surface tanks for holding and cleaning the fluids, surface processing equipment for cleaning, cooling, mixing, and testing the fluid, and interconnecting piping having valves, meters, etc., for hydraulically connecting all of the various components.

In typical hydrocarbon well drilling operations, drilling fluids are circulated down through the drill pipe down to the drilling assembly, and flowing up in the annulus defined between the drill string and the inside wall of the wellbore, bringing back to the surface the cutting debris generated by the drill bit. In addition, the returning drilling fluids bring back the entrained heat generated by cutting. The increasing frequency of drilling into deeper—and thus hotter—strata has required the cooling of the drilling fluids. Chilling and cooling systems have been developed for cooling the wellbore fluids, such as that described in U.S. Pat. No. 4,215,753. In this system, the drilling fluids are circulated through heat exchangers at the surface and returned to the wellbore. However, in deeper wells, there is significant heat transfer as the cooled or chilled fluids are pumped down the wellbore. Insulated drill pipe is frequently employed in combination with a surface cooler or chiller to address these situations.

The impacts of temperature on the circulating wellbore fluid can be significant. The rheological properties of drilling fluids are frequently approximated to be independent of pressure and temperature. This may be a satisfactory approximation in shallow wells where the temperature changes are not large, because the rheological variations with the temperature change are small. However, in those situations where the temperature changes are large, or in situations where there is a small margin between pore pressure and fracture pressure thereby requiring precise hydraulic calculations to achieve well control, the effects of temperature and pressure on wellbore hydraulics need to be known so that affirmative steps may be taken to manage the temperature and pressure of the fluids circulating within the wellbore. For purposes of this disclosure and claims, the phrase "managing properties of a circulating wellbore fluid" shall mean adjusting controllable parameters of the circulating wellbore fluid to achieve temperatures and pressures which: (1) are within the capacity of the surface and subsurface equipment; (2) do not unintentionally exceed the fracture gradient of the reservoir; (3) maintain control of wellbore pressures; (4) minimize reservoir damage; (5) eliminate or minimize hazardous conditions for personnel; and (6) increase operational efficiency and decrease operational expense. The controllable parameters, each of which may be largely dependent upon the others, shall be understood to mean: (1) the temperature of the circulating wellbore fluid; (2) the chemical composition and pH of the circulating wellbore fluid; (3) the pump pressure applied to the circulating wellbore fluid; (4) the volumetric flow rate of the circulating wellbore fluid; (5) the density of the circulating wellbore fluid; (6) the viscosity of the circulating wellbore fluid; (7) the heat capacity of the circulating wellbore fluid; (8) the yield point of the circulating wellbore fluid; (9) the solids content of the circulating wellbore fluid; (10) the rate of penetration; (11) the directional program; (12) the casing program; (13) the cementing program; (14) the configuration of the drilling string, including any insulation which is utilized in the drill string; and (15) the configuration of the bottom hole assembly.

The management of the temperature and pressure of the circulating fluids provides a number of advantages, including obtaining greater precision in well control, optimizing drilling rates, protecting equipment and personnel, and reducing overall operational costs.

Temperature affects the rheology of the circulating fluids, so the behavior and interactions of the water, clay, polymers and solids in a mud or circulating fluid are impacted according to changes in temperature. In general, a drilling mud gets thinner with increases in temperature. However, the specific impact is influenced by the type and total solids in the drilling mud. Clays can be dispersed by higher temperatures, which can result in increased flocculation and severe thickening. Laboratory testing and practical experience have shown that temperature can have a substantial effect on the flow characteristics of non-Newtonian fluids like drilling muds. Temperatures of the circulating fluids raise various issues concerning degradation of the fluid and on the performance and efficiency of the overall hydraulic system. For example, some ingredients of drilling fluids are particularly impacted by elevated temperatures, such as the hydrolysis of starches, depolymerization of certain organic thinners, or irreversible chemical reactions (such as that of clay and lime). These impacts can affect the filtration, viscosity and shear strength of the drilling fluid which, if not attended, can have significant consequences on well control, drilling cost, formation protection, and other factors.

Laboratory testing and field experience have demonstrated how the impact of temperature on the rheological properties of a wellbore circulating fluid is influenced by the composition of the fluid. For example, it has been shown that thinning will occur in a mud with 25 ppb of bentonite, 350 ppb of barite and 9 ppb of lignosulfonate until a temperature of 220 degrees F. is reached. However further increases in temperature, to 320 degrees F., result in a significant increase in viscosity. If the concentration of lignosulfonate is increased to 15 ppb, the higher viscosity at 320 degrees F. is prevented. It has also been found in laboratory testing that gel strength of a fluid can be significantly impacted by bentonite content, pH, and temperature.

Because of the impact of the fluid system on well control, safety, reservoir protection, drilling efficiency, and related factors, and the influence of circulating fluid temperature on other fluid properties, there is a distinct advantage in being able to manage the circulating fluid temperature on a near real-time basis. However, this goal is complicated by a number of factors including the initial composition of the circulating fluid, the work imparted to the fluid, the heat transfer taking place throughout the hydraulic system, and the changing composition of the circulating fluids as wellbore materials, such as cuttings, are circulated from the wellbore by the circulating fluid. As fluids are circulated through the hydraulic system described above, the temperatures of the fluid may vary according to the real time location of the fluid within the hydraulic system. Liquids expand when heat is applied and are compressed by pressure. Therefore, the density of the fluid decreases with increasing temperature, but increases with increasing pressure. As a drilling fluid is pumped downhole, its density is changed by the temperature and pressure effects. Thus the effective management of the temperature and pressure of a circulating wellbore fluid, while presenting a number of advantages, is a complicated problem for which a solution is offered by embodiments of the present invention.

SUMMARY OF THE INVENTION

The present invention discloses embodiments of a system and method which enable the management of the temperature and pressure of the fluids circulating within the hydraulic system. It is to be understood that "management of the temperature and pressure" will typically involve the determination of temperatures and pressures which fall within an acceptable range for producing acceptable results, based upon available field history, well history, statistical analysis, and other informational and/or analytical tools. While the optimal temperatures and pressures for optimizing all objectives may be ascertainable, the present invention will also allow the determination of temperatures and pressures which are the most economically realistic based upon the observed real-time measurements and operational constraints. Depending upon the foreseeable risks, "good enough" may be preferable over perfection.

An embodiment of the invention features an output fluid piping system into which a fluid enters, the fluid exiting from the wellbore. The output fluid piping system will typically feature a return line connected to an outlet of the wellhead or drilling head, with the outlet receiving flow from the annulus between the internal diameter of the casing and open-hole of the borehole and the drillpipe or workover string. The return line will typically return the fluid from the borehole into a fluid processing system. A sensor is configured to sense one or more properties of the fluid in the output fluid piping system to ascertain the properties of the fluid exiting the well, upstream of any processing equipment, where the property may be the mass flow rate, the volumetric flow rate, the flowing temperature, the fluid density, the fluid viscosity, the oil/water ratio of the fluid, the total solids content of the fluid, the chloride content, the shear stress, the gel strength, the plastic viscosity, the yield point, the thermal conductivity, and the specific heat capacity. In most cases, this first sensor will ascertain, at a minimum, the temperature and pressure of fluid in the output fluid piping system. A variety of these fluid properties may be ascertained by a Coriolis flow and density meter. This sensor has digital transmission capabilities and provides input to a digital processor of fluid properties ascertained by this sensor via either wired or wireless transmission.

The system has a fluid processing and storage structure to process and store fluid received from the output fluid piping system yielding a processed fluid. The components of the fluid processing and storage structure form a staged cleaning system comprising degassers, shakers, desanders, and desilters, degassers, with the cleaned fluid flowing into mixing and/orstorage tank(s). The mixing/storage tank holds the cleaned fluid and provides a mixing facility for supplementing the fluid system with additives as necessary for meeting ongoing downhole conditions, such as lost circulation zones, high temperature zones, high pressure zones, etc. This fluid processing and storage structure will typically have a solids control tank, an intermediate tank, and an active suction tank. A sensor may be configured to detect a number of different fluid property measurements for each of these three tanks, with each sensor configured to detect temperature, the density, oil/water ratio, solids content, chloride content, shear stress, gel strength, plastic viscosity, yield point, thermal conductivity, and the specific heat capacity. The sensors may have digital transmission capabilities and provide input to the digital processor of the fluid properties ascertained by the particular sensor. Based upon the data received from these sensors, the digital processor may then provide instructions for either manual or automated adjustment of valving or other comparable flow control devices, such as a variable flow pump which may, as desired, direct the fluid for further recirculation within the fluid processing and storage structure, direct the fluid for temperature adjustment to a temperature adjustment apparatus, or direct flow to the mud pumps, which take suction from the storage tanks for returning the processed fluid to the wellbore.

An adjustable temperature control apparatus is hydraulically connected to the fluid processing and storage structure to receive processed fluid from an outlet, which is typically, but not necessarily, from the active suction tank, with the adjustable temperature control apparatus having a discharge back into the solids control tank, thereby allowing the recirculation of the fluids to obtain a desired temperature, resulting in a managed temperature fluid for return to the wellbore. Sensors are located at the inlet and outlet of the adjustable temperature control apparatus, with these sensors typically detecting the temperatures, pressures, and flow rates of the incoming and outflowing fluid, with these detected measurements being provided to the digital processor. A control apparatus, such as a manually operated controller or an actuator which controls flow of a heat transfer fluid into or around the temperature control apparatus, may be controlled by instructions from the digital processor which instructions are based, at least in part, upon input received and processed by the digital processor. The adjustable temperature control apparatus is controlled to realize the managed temperature fluid, which is returned to the active suction tank for introduction back into the wellbore.

Other embodiments of the system may include a heat exchanger for the temperature control apparatus. Other embodiments may include an additional temperature control apparatus hydraulically connected to the output fluid piping system.

Another embodiment of the system provides a bottom hole assembly disposed in the borehole, in which the bottom hole assembly has a sensor which provides bottom hole temperature and pressure for transmission to the digital processor. The bottom hole assembly may further comprise, measurement while drilling/logging while drilling components which provide wellbore trajectory, resistivity, porosity, sonic velocity and gamma ray logs.

Another embodiment of the system provides for flow of a managed temperature fluid into drill string/casing-borehole annulus (i.e., the backside) with an additional sensor adapted to detect fluid properties of the managed temperature fluid, including mass flow rate, the volumetric flow rate, the flowing temperature, the fluid density, the fluid viscosity, the oil/water ratio of the fluid, the total solids content of the fluid, the chloride content, the shear stress, the gel strength, the plastic viscosity, the yield point, the thermal conductivity, and the specific heat capacity. Separate sensors may be utilized to provide temperature and pressure measurements. Output from these sensors is provided to the digital processor.

The digital processor may be enabled to receive the various sensor output via a data acquisition system connected (wired and/or wireless) to the fluid property sensors described above, typically on a real time basis. The digital processor may further be provided with a dynamic well model which incorporates historical PVT, hydraulic and temperature data from a specific well or field. The digital processor may further store a customer supplied well plan which may include, among other information, a formation characterization, the geothermal gradient, the well trajectory, pore pressure predictions, fracture gradient predictions, casing plan, cement plan, drill string and BHA plan, hydraulic performance curves for the BHA components, a fluid plan, temperature limitations on surface and subsurface equipment, and dynamic drilling parameters, such as ROP, flow rate, torque, rotation velocity, etc.

The digital processor may further store a linear and non-linear multivariate statistical model based on offset well data, a current well database, and an offset well database. Information from the multivariate statistical model may be utilized to identify solutions and adjustments based upon the observation of real time data acquired from the network of sensors included in the system. In addition to the control apparatus (manual or automated) or system which controls flow of a heat transfer fluid into or around the temperature control apparatus, the digital processor may provide control to a backpressure flow control apparatus, and a backpressure fluid pump.

BRIEF DESCRIPTION OF THE DRAWINGS

FIG. 2 is a sectional side view of a representative drill pipe along its long axis which may be used with embodiments of the present invention.

FIG. 3 is a sectional view of a representative drill pipe along its diameter which may be used with embodiments of the present invention.

DETAILED DESCRIPTION OF THE EMBODIMENTS

Figure 1:
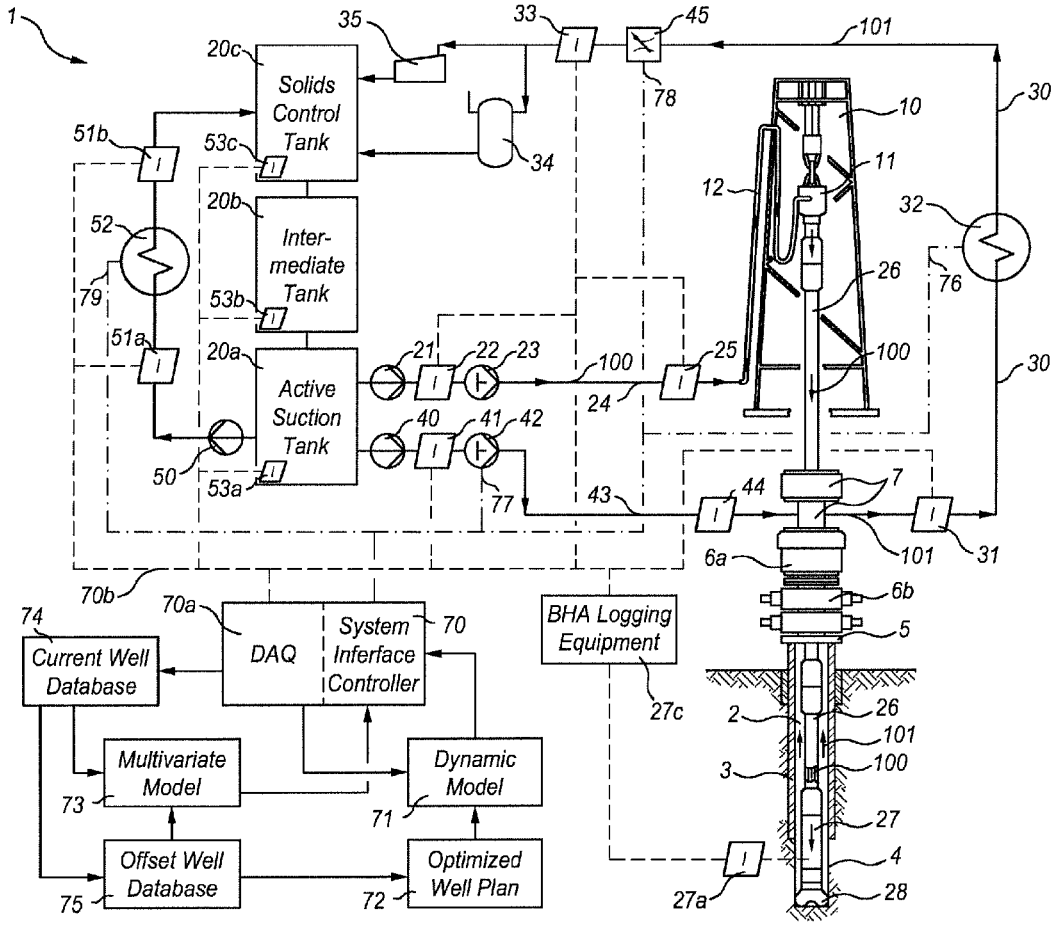
FIG. 1 schematically shows an embodiment of a system which manages the temperature and pressure of a circulating wellbore fluid.

Referring now to the figures, FIG. 1 schematically depicts an embodiment of the disclosed system 1 for ascertaining and managing properties of a circulating wellbore fluid. As shown, the system is utilized a wellbore which has a cased hole portion 2 and an openhole portion 4. The cased hole portion 2 is lined with casing 3. Pressure control of the wellbore is maintained by a wellhead 5 which is made up to the top joint of casing 3. A blowout preventer assembly comprising an annular preventer 6*a* and a ram blowout preventer 6*b* is made up to the wellhead 5. A rotating control device 7 (RCD) maintains a pressure tight barrier for diverting well returns—such as pressurized gas, fluids, and cuttings—through an outlet below the rig floor to the surface separation system.

Drilling rig 10 may have a top drive assembly 11. Fluids are typically introduced from the mud pumps into the drilling string 26 through a stand pipe 12. The surface storage structure for the fluids 20 (hereinafter, the "active pit system") typically comprises an active suction fluid storage structure 20*a*, an intermediate fluid storage structure 20*b*, and a solids control fluid storage structure 20*c*. A fluid pre-charge pump 21 imparts an initial pressure to the fluid. A Coriolis flow and density meter 22 may be disposed between the pipe interval between the discharge of pre-charge pump 21 and the suction of high pressure pump 23. The Coriolis flow and density meter 22 may measure, among other flow properties, the following properties of the input fluid 100 into the wellbore: (1) mass flow rate; (2) volumetric flow rate; (3) temperature; (4) density; and (5) viscosity. The data acquired from the Coriolis flow and density meter 22 may be forwarded via wireless or wired transmission to a digital processor 70. The input fluid 100 is discharged from high pressure pump 23 into the input fluid piping 24 for introduction into the wellbore. Prior to being introduced into the wellbore, a sensor 25 may measure the temperature and pressure of the high pressure input fluid 100.

In conventional drilling and workover operations, the high pressure input fluid 100 is pumped into a drill string 26, which comprises a plurality of joints of drill pipe. The drill pipe may be of a type having a selectively applied internal coating 26*a* or a selectively applied external coating 26*b*. Internal coating 26*a* may be either/or a coating which insulates and reduces the rate of heat transfer, such as that disclosed in U.S. Pat. No. 5,715,895 by one of the inventors herein, which is incorporated herein by this reference. In addition, or alternative, the coating may be one which which reduces hydraulic friction as the fluid is pumped down the drill string 26.

At the end of drill string 26 is bottom hole assembly 27 which may include measurement and logging while drilling (MWD/LWD) components which may measure, among other things, temperature, pressure, wellbore trajectory, resistivity, porosity, sonic velocity, and gamma ray radiation. The bottom hole assembly 27 may have a BHA data transmission device 27*a* which transmits the MLD/LWD data to BHA data logging equipment 27*c*. At the end of bottom hole assembly 27 is drill bit 28, through which high pressure input fluid 100 flows, typically through nozzles in the drill bit.

It is to be appreciated that once the fluid exits the drill bit 28, it is utilized to carry cuttings out of the bottom of the borehole, and the solids concentration of the fluid typically changes as a result of this process. Thus, the output fluid 101 frequently has significantly different properties from the input fluid 100. Output fluid 101 typically flows out of the wellbore in the annulus formed by the internal diameter of the openhole portion 4 of the wellbore and the drill string 26 and, further uphole, by the annulus formed by the internal diameter of the casing 3 and the external diameter of the drill string. The output fluid exits the wellbore into the output fluid piping system 30.

Upon flowing out of the wellbore, typically through rotating control device 7, the output fluid 101 flows through output fluid piping system 30. The output fluid piping system may have a sensor 31 which may measure, among other parameters, the temperature and pressure of the high pressure output fluid 101 closely adjacent to the outlet from the wellbore and transmits the data to the digital processor 70. The output fluid piping system 30 may further comprise a fluid temperature control apparatus 32 through which the output fluid 101 flows. This fluid temperature control apparatus 32 may be controlled by a controller 76 which is either operated manually or is operated by digital processor 70, typically by controlling the flow of a heat transfer fluid into or around the fluid temperature control apparatus 32. The output fluid piping system 30 may further comprise a Coriolis flow and density meter 33 which measures, among other things, the following properties of the output fluid 101: (1) mass flow rate; (2) volumetric flow rate; (3) temperature; (4) density; and (5) viscosity. The data acquired from the Coriolis flow and density meter 33, as with the data acquired from the other sensors, may be forwarded via wireless or wired transmission to a digital processor 70. The output fluid 101 may thereafter flow through output fluid gas removal equipment 34, and then into output fluid solids removal equipment 35.

Following the processing of the output fluid 101 in the active pit system 20, as described further below, the resulting fluid is a temperature managed input fluid 100. The input fluid 100 may be introduced from the mud pumps 21, 23 into the drilling string 26 through a stand pipe 12, as described above. In addition, or alternatively, the input fluid 100 may be routed through a wellbore back pressure fluid pre-charge pump 40 and high pressure pump 42 for applying backpres sure to the wellbore or to reverse circulate (i.e., down the annulus and up through the drill string 26) by pumping the input fluid 100 (back pressure fluid in this case) through back pressure fluid piping 43. A Coriolis flow and density meter 41 may be disposed between the pre-charge pump 40 and high pressure pump 42 which measures, among other things, the following properties of the back pressure fluid: (1) mass flow rate; (2) volumetric flow rate; (3) temperature; (4) density; and (5) viscosity. The data acquired from the Coriolis flow and density meter 41 is forwarded via wireless or wired transmission to digital processor 70. Prior to being pumped down the backside, temperature and pressure measurements may be made of the high pressure back pressure fluid with sensor 44 and this data may be provided via wireless or wired transmission to the digital processor 70. The backside of the wellhead 5 may be equipped with a back pressure flow control apparatus 45 which may be actuated by signals provided by digital processor 70 or operated manually based upon output generated by the digital processor.

Referring now to the active pit system 20 and its subcomponents, the active pit system 20 may comprise an active suction tank 20*a*, an intermediate tank 20*b*, and a solids control tank 20*c*. Flow of output fluid 101, after flowing through the output fluid gas removal equipment 34 and output fluid solids removal equipment 35 is received into solids control tank 20*c*, which is hydraulically connected to intermediate tank 20*b*, which is hydraulically connected to active suction tank 20*a*. Each of these tanks may comprise a sensor 53*a*, 53*b*, 53*c*, which measure a variety of fluid properties including temperature, density, rheology, oil/water ratio, solids content, chloride content, shear stress, gel strength, plastic viscosity, yield point, thermal conductivity and specific heat capacity. The data acquired from the sensors 53*a*, 53*b* and 53*c* may be forwarded via wireless or wired transmission to a digital processor 70.

A major component of managing the temperature of the circulating fluid is temperature control apparatus 52, which may take fluid from active suction tank 20*a*. The temperature control device may be one of various devices known in the art such as a refrigeration unit, thermostatically controlled devices, devices utilizing expansion valves for cooling or heat exchangers such as that disclosed in U.S. Pat. No. 4,215,753, which was invented by one of the inventors herein. The disclosures made in the '753 patent are incorporated herein by this reference. Upstream of the temperature control apparatus 52 is a pre-charge pump 50 which takes suction from active suction tank 20*a*. A sensor 51*a* detects the temperature, pressure, and flow measurements of fluids supplied to the input of the fluid temperature control apparatus 52 and may provide the detected data to the digital processor 70. Likewise, sensor 51*b* detects the temperature, pressure, and flow measurements of fluids being returned to the active pit system 20 from the fluid temperature control apparatus 52, and this data may also be provided to the digital processor 70. It is to be noted that the temperature control apparatus may provide either cooling or heating to the circulating fluid. While the demand is typically to cool the circulating fluid, there are some applications where a heated circulating fluid is desired.

Data acquired from the various sensors of the described system is provided via wireless or wired connections to the digital processing unit 70, which provides an operator interface. Digital processing unit 70 also compiles and stores data received from the various sensors, and analyzes the data according to inputted user instructions and inputted historical data including data received from the modules described below. Digital processing unit 70 may either actively control various actuated devices in the system, or provide instructions for making manual adjustments, which manage the temperature and pressure of the wellbore fluids being processed through the system. The digital processing unit 70 comprises a real time data acquisition system (DAQ) which receive field transmissions 70*b* (wired & wireless) of the various real time fluid property sensors in the system. The digital processing unit may comprise a module 71 which incorporates PVT, hydraulic and temperature effect information to present dynamic well modeling scenarios.

The digital processing unit 70 may further comprise and utilize for purposes of its analysis and control, a module 72 which stores a customer supplied well plan which includes formation characterization information, geothermal gradient, well trajectory information, pore pressure predictions, fracture gradient predictions, casing plan, cement plan, drill string and BHA plan, hydraulic performance curves of BHA elements, fluid plan, temperature limitations on surface equipment, temperature limitations on subsurface equipment, and dynamic drilling parameters, such as rate-of-penetration, flow rate, torque, rotation velocity, etc.

The digital processing unit 70 may further comprise and utilize for purposes of its analysis and control, a module 73 which stores a linear and non-linear multivariate statistical model based on offset well data, a module 74 which stores a current well database, a module 75 which stores an offset well database.

Utilizing and analyzing the received and stored data, the digital processing unit 70 may control devices through a system control to output fluid temperature control apparatus 76, a system control to backpressure fluid pump 77, a system control to backpres sure flow control apparatus 78, and a system control to input fluid temperature control apparatus 79. Thus, the various end devices may be controlled by the digital processing unit to arrive at a managed pressure and temperature which considers the various inputted data and optimizes the system according to the existing constraints. Alternatively, the digital processor 70 may analyze the received and stored data and provide instructions for manual manipulation of various control devices and for making adjustments to the equipment and drilling fluid composition to arrive at a satisfactory solution.

While the above is a description of various embodiments of the present invention, further modifications may be employed without departing from the spirit and scope of the present invention. Thus the scope of the invention should not be limited according to these factors, but according to the following appended claims.

What is claimed is:

1. A system for ascertaining and managing properties of a circulating wellbore fluid comprising:

an output fluid piping system into which a fluid enters, the fluid exiting from a wellbore;

a first sensor to sense temperature and pressure of the fluid in the output fluid piping system;

a fluid processing and storage structure to process and store fluid received from the output fluid piping system wherein the received fluid is processed in the fluid processing and storage structure resulting in a processed fluid;

a second sensor to sense a property of the processed fluid within the storage structure wherein the property is at least one of the properties selected from the group consisting of mass flow rate, volumetric flow rate temperature, density, viscosity, oil/water ratio, total solids content, chloride content, shear stress, gel strength, plastic viscosity, yield point, thermal conductivity, and specific heat capacity, wherein the second sensor provides input to a digital processor of the at least one fluid properties;

an adjustable temperature control apparatus hydraulically connected to the fluid processing and storage structure to receive the processed fluid from a first outlet, manage the temperature of the processed fluid, and return the fluid to the fluid processing and storage structure through a first inlet, resulting in a managed temperature fluid inside the fluid processing and storage structure;

a first inlet conduit between the fluid processing and storage structure and the wellbore for receiving managed temperature fluid;

a third sensor to sense a property of the managed temperature fluid within the first inlet conduit, wherein the property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity, wherein the third sensor provides input to a digital processor of the at least one fluid properties;

a controller on the adjustable temperature control apparatus which, in response to instructions determined by the digital processor, allows adjustment of the adjustable temperature control apparatus to realize the managed temperature fluid;

wherein the managed temperature fluid is introduced into a drill pipe terminating with a bottom hole assembly disposed inside the wellbore.

2. The system of claim 1, wherein the digital processor provides output which is utilized by the controller to manage the temperature of the processed fluid.

3. The system of claim 2 wherein the output provided by the digital processor controls flow of a heat transfer fluid to the temperature control apparatus.

4. The system of claim 3 wherein the heat transfer fluid is at least one of the fluids selected from the group consisting of water, seawater, glycol, ethylene glycol, propylene glycol deionized water, air, refrigerated air, and dielectric fluid.

5. The system of claim 1 wherein the temperature control apparatus comprises a heat exchanger.

6. The system of claim 1 further comprising a fourth sensor to sense the temperature and pressure of the managed temperature fluid within the wellbore adjacent to the bottom hole assembly, wherein the fourth sensor provides input to a digital processor of the temperature and pressure.

7. The system of claim 1 further comprising an adjustable flow control apparatus disposed in the output fluid piping system to regulate a rate of flow and pressure of the fluid exiting from the wellbore.

8. The system of claim 7 wherein the output provided by the digital processor controls the adjustable flow control apparatus.

9. A system for ascertaining and managing properties of a circulating wellbore fluid comprising:

an output fluid piping system into which a fluid enters, the fluid exiting from a wellbore;

a first sensor to sense temperature and pressure of the fluid in the output fluid piping system;

a fluid processing and storage structure to process and store fluid received from the output fluid piping system wherein the received fluid is processed in the fluid processing and storage structure resulting in a processed fluid;

a second sensor to sense a property of the processed fluid within the storage structure, wherein the property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity, wherein the second sensor provides input to the digital processor of the at least one fluid properties;

a first temperature control apparatus hydraulically connected to the fluid processing and storage structure to receive the processed fluid from a first outlet, manage the temperature of the processed fluid, and return the fluid to the fluid processing and storage structure through a first inlet, resulting in a managed temperature fluid inside the fluid processing and storage structure;

a first inlet conduit between the fluid processing and storage structure and a string of drill pipe disposed within the wellbore for receiving managed temperature fluid; and a third sensor to sense a property of the managed temperature fluid within the first inlet conduit, wherein the property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity, wherein the third sensor provides input to the digital processor of the at least one fluid properties; and a controller on the adjustable temperature control apparatus which, in response to instructions determined by the digital processor, allows adjustment of the adjustable temperature control apparatus to realize the managed temperature fluid.

10. The system of claim 9 further comprising a second adjustable temperature control apparatus hydraulically connected to the output fluid piping system to receive the fluid from the wellbore, manage the temperature of the fluid exiting from the wellbore, and return the fluid to the output fluid piping, resulting in a managed temperature fluid inside the output fluid piping system.

11. The system of claim 9 further comprising an adjustable flow control apparatus [disposed in the output fluid piping system to regulate a rate of flow and pressure of the fluid exiting from the wellbore.

12. The system of claim 9 wherein the first temperature control apparatus manages the equivalent circulating density of the processed fluid received from the first outlet.

13. The system of claim 11 wherein the output provided by the digital processor provides instructions which operate the controller of the adjustable flow control apparatus.

14. The system of claim 9 further comprising a second inlet conduit between the fluid processing and storage structure and an annulus defined between an exterior of the string of drill pipe and an interior of the wellbore for receiving temperature adjusted fluid and a fourth sensor to sense the temperature and pressure of the temperature adjusted fluid within the second inlet conduit, wherein the fourth sensor provides input to the digital processor of the temperature and pressure.

15. The system of claim 9 wherein the string of drill pipe comprises a plurality of coated piping segments.

16. The system of claim 15 wherein the coated piping segments comprise a coating which manages the transfer of energy between the managed temperature fluid within the string of drill pipe and a fluid outside of the string of drill pipe.

17. The system of claim 15 wherein the coated piping segments comprise a coating which reduces hydraulic friction as the managed temperature fluid flows through the string of drill pipe.

18. A method for controlling a downhole temperature and pressure of a wellbore fluid circulating within a well comprising the steps of:

detecting in real time at least one fluid property of the wellbore fluid as the wellbore fluid is introduced into the well, wherein the fluid property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity;

detecting in real time at least one fluid property of the wellbore fluid as the wellbore fluid flows out of the well wherein the fluid property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity;

calculating a setpoint surface temperature and a setpoint surface pressure which are required to achieve a desired downhole temperature and pressure at a desired depth in the well, where the temperature and pressure setpoints are dependent on a dynamic model of projected drilling conditions and/or a multivariate model from offset or historical well data;

adjusting the setpoint surface temperature and the setpoint surface pressure which are required to achieve the desired downhole temperature and pressure at a desired depth in the well, where the adjustment is based upon the real time fluid property detected in the wellbore fluid as the wellbore fluid is introduced into the well and the real time fluid property detected in the wellbore fluid as the wellbore fluid flows out of the well; and managing the surface temperature, pressure and inflow rate of the wellbore fluid introduced into the well to maintain the setpoint surface temperature and setpoint surface pressure.

19. The method of claim 18, wherein a string of drill pipe is disposed within the wellbore and the wellbore fluid circulating within the well is pumped down the drill string and flows up the wellbore through an annulus defined by a space between and exterior of the drill string and an interior of the wellbore.

20. The method of claim 19 wherein the string of drill pipe comprises a plurality of coated piping segments.

21. The method of claim 20 wherein the coated piping segments comprise a coating which manages the transfer of energy between the managed temperature fluid within the string of drill pipe and a fluid outside of the string of drill pipe.

22. The method of claim 20 wherein the coated piping segments comprise a coating which reduces hydraulic friction as the wellbore fluid flows down the drill string.

23. A system for ascertaining and managing properties of a circulating wellbore fluid comprising:

an output fluid piping system into which a fluid enters, the fluid exiting from a wellbore;

an active pit system connected to the output fluid piping system, the active pit system comprising a solids control tank receiving the fluid from the output fluid piping system, an intermediate tank in hydraulic communication with the solids control tank, and an active suction tank in hydraulic communication with the intermediate tank;

an adjustable temperature control apparatus hydraulically connected to the active pit system, wherein the adjustable temperature control apparatus receives fluid from an active pit system outlet, adjusts the temperature of the fluid and returns the fluid to the active pit system through an active pit system inlet;

a first sensor to sense a property of the fluid in the active pit system outlet, wherein the property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity, wherein the first sensor provides input to a digital processor of the at least one fluid properties;

a second sensor to sense a property of the fluid in the active system inlet, wherein the property is at least one of the properties selected from the group consisting of mass flow rate, volumetric flow rate, temperature, density, viscosity, oil/water ratio, total solids content, chloride content, shear stress, gel strength, plastic viscosity, yield point, thermal conductivity, and specific heat capacity, wherein the second sensor provides input to a digital processor of the at least one fluid properties; and a controller on the adjustable temperature control apparatus which, in response to instructions determined by the digital processor, allows adjustment of the adjustable temperature control apparatus to realize the managed temperature fluid.

* * * * *